United States Patent [19]

Rantanen et al.

[11] Patent Number: 4,712,506

[45] Date of Patent: Dec. 15, 1987

[54] DEVICE FOR TWO-SIDED COATING OF A PAPER WEB

[75] Inventors: Rauno Rantanen, Imatra; Sivert Westergård, Järvenpää, both of Finland

[73] Assignee: Oy Wärtsilä Ab, Helsinki, Finland

[21] Appl. No.: 834,559

[22] Filed: Feb. 28, 1986

[30] Foreign Application Priority Data

Mar. 7, 1985 [FI] Finland ..... 850917

[51] Int. Cl.[4] ..... B05C 11/04; B05C 5/02

[52] U.S. Cl. ..... 118/103; 118/117; 118/126; 118/411

[58] Field of Search ..... 118/117, 122, 103, 126, 118/410, 411, 413

[56] References Cited

U.S. PATENT DOCUMENTS

| | | | |
|---|---|---|---|
| 597,405 | 1/1898 | George et al. | 118/117 X |
| 1,439,183 | 12/1922 | Martin | 118/117 X |
| 4,063,531 | 12/1977 | Zitzow | 118/122 |

*Primary Examiner*—John P. McIntosh

*Attorney, Agent, or Firm*—Birch, Stewart, Kolasch, & Birch

[57] ABSTRACT

A system for two-sided coating of a running paper web. The device comprises an application device for spreading the coating material over both sides of the web running through a first nip formed by a rotating counter roll and a levelling member.

According to the invention, the device includes an auxiliary roll, which is, in the direction of progress of the web, fitted at a certain distance from the first nip and which, together with the counter roll, forms a second nip for the web which has followed along with the said roll over the distance. The diameter of the auxiliary roll is substantially smaller than the diameter of the counter roll, and the face of the auxiliary roll is substantially harder than that of the counter roll. By means of the invention, the risk of damaging the coating at the side of the web facing the roll can be reduced by the web being detached from the second nip formed between the rolls.

11 Claims, 1 Drawing Figure

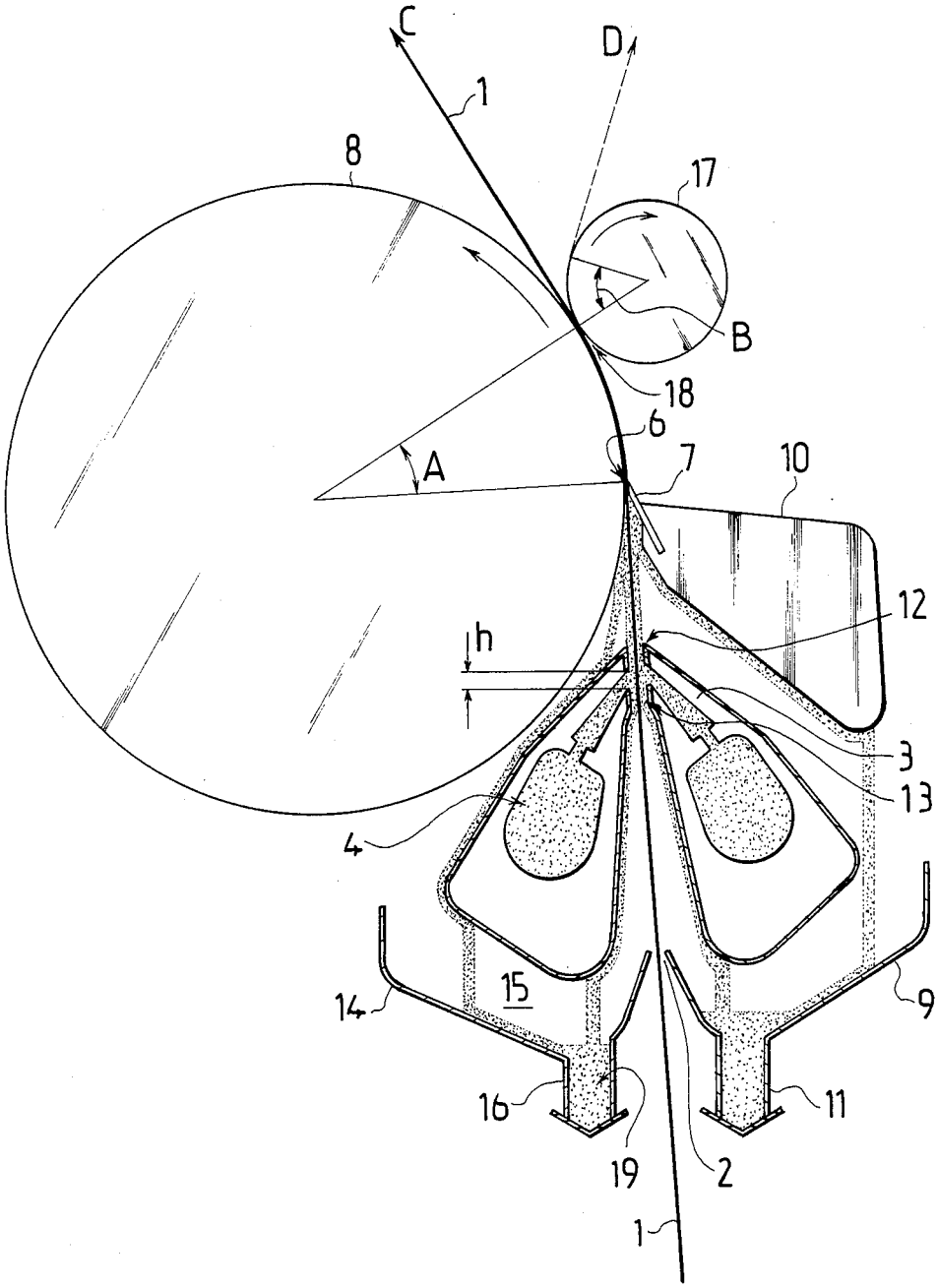
C
D
1
8
17
B
18
6
7
10
A
12
h
3
13
4
15
14
9
16
11
19
2
1

DEVICE FOR TWO-SIDED COATING OF A PAPER WEB

BACKGROUND OF THE INVENTION

The present invention concerns a system or device for two-sided coating of a paper web.

Devices of this type are described, for example, in the following papers:

(1) DE Pat. No. 29 15 300
(2) FI Patent Application No. 83 0674
(3) FI Patent Application No. 83 3306
(4) Sivert Westergård: "Twostream Coater—Versatile New Tools for Coating in Spotlight", *Paper Age*, May 1984.

A problem in the prior-art devices has been the inability to produce a faultless coating also on the face of the web facing the roll. The present invention can be fitted to a coating device of the type described in cited papers (1) to (4).

In the so-called Billblade-type coating device of the cited paper No. (1), attempts have been made to solve this problem so that the web is detached from the roll immediately after the coating blade. This solution has, however, caused the problem that the coating device becomes highly sensitive to variations in the tractive load on the web after the coating blade. An excessively high tractive load causes tearing, an excessively low tractive load again makes the web follow along with the counter roll, in which case the coating facing the roll becomes damaged. Moreover, on the roll-side face of the web, at high speeds (≧600 m/min) "mist" is formed, which likewise damages the roll-side coating.

SUMMARY OF THE INVENTION

The object of the present invention is to eliminate the drawbacks present in the prior-art devices described above and to provide a coating device by means of which also the roll-side coating of the web can be made flawless.

This objective has been achieved by means of a device in accordance with the invention so that, after the levelling member (blade or rod) an auxiliary roll of smaller diameter and harder face material, as compared with the counter roll, is fitted against the counter roll. In such a case, the web follows along with the counter roll a certain distance after the levelling member. Then, the web can be easily detached from the nip between the counter roll and the auxiliary roll, or from the harder face of the auxiliary roll.

By means of the invention, considerable advantages are obtained. Thus, the risk of damaging of the roll-side coating is reduced, because the web is detached from a nip between rolls. Also, the formation of mist taking place at high speeds is eliminated, as the web can follow the counter roll. The running quality of the device is also improved, because, when being a driven roll, the auxiliary roll promotes the feeding of the web. Since the detaching of the web takes place from a nip between two rolls, no power is required for the detaching. Thereat, variations in the tractive load can be permitted without risk of tear.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus are not limitative of the present invention, and wherein:

The sole FIGURE shows a schematical sectional view of the device of the present invention.

DETAILED DESCRIPTION OF PREFERRED EMBODIMENTS

In the drawing, numeral 1 denotes the running web, which moves in the direction from the bottom upwards. Through the slot 2 the web 1 moves into a substantially closed space 15, wherein there is a device 3 for the application of the coating material. In the application device 3 the web 1 enters into contact with the coating material provided therein. Coating material is pumped into the interior 4 of the application device 3 through feed pipes not shown, whereat the pumping pressure is controlled so that in the application device 3 there is no real positive pressure. On the contrary, in the feed pipes there must be some positive pressure so that the surface of the coating material in the interior 4 of the application device 3 adopts the desired level. In the application device 3, the coating material adheres to the web 1 and runs along with the web into a levelling nip 6, where the coating is levelled by means of a doctor blade 7 and a roll 8 placed at the opposite side of the web 1.

At the inlet side of the levelling nip 6, the direction of running of the web 1 can be arranged so that it differs from the tangential plane of the roll 8. In the levelling nip 6 it is possible to adjust the angle of the blade 7, and also the nip load caused by it and acting upon the coating. The choice of the adjustment values is mainly determined by the paper quality, the web speed, and the nature of the coating material, as well as, also, by the thickness and flexibility of the blade 7.

The control systems of the application device 3 are shown only schematically, and only at one side of the application device 3. Both halves of the application device 3 are supported at a fixed point, not shown, whose position can be adjusted to some extent. The angle adjustment of the application device 3 is obtained by means of a moment of rotation acting relative to this fixed point. The halves of the application device 3 are adjusted so that a slot of desired magnitude is formed at the inlet edge 13 and at the outlet edge 12 of the application device 3.

Around the application device 3, two collecting troughs 9 and 14 are provided, which together form the collecting space 15. Any extra quantities of coating material, which drop from the leveling nip 6 and to some extent also from the slot at the inlet edge 13 of the application device 3, are collected in this collecting space. The collecting troughs 9 and 14 also act as shields for the application device and, together with the roll 8, blade 7, and holder 10, form a substantially closed space, which protects the application device 3 and the entire coating process very well. The coating material 19 gathered in the bottom portion of the collecting space 15 is passed along pipes 11 and 16 back to the coating-material feed system, from which it is passed through feed pipes into the application device 3.

In order that the device could be used for coating by means of different coating materials, it is important that the distance of contact h between the web 1 and the coating is sufficiently long. In the coating device in accordance with the invention, it is possible to use conventional pigment and size coating materials. The viscosity of the coating material should be preferably lower than 3000 mPas. In the levelling nip 6, the roll 8 may run somewhat faster than the web 1.

In the direction of running of the web 1, at a distance defined by angle A from the nip 6, there is an auxiliary roll 17, which, together with the counter roll 8, forms a second nip 18 for the web 1. This second nip 18 is, measured along the face of the counter roll 8, preferably 10 to 30 cm from the first nip 6. The coated web 1 runs the distance between the nips 6 and 18 as pressed against the counter roll 8.

The diameter of the auxiliary roll 17 is substantially smaller than that of the counter roll 8, and the face of the auxiliary roll is substantially harder than that of the counter roll 8. The auxiliary roll 17 is preferably driven by a motor, which facilitates the feeding of the web 1.

The coated web 1 coming out of the second nip 18 is arranged to be detached either in the direction (C) of the common tangent of the rolls 8, 17, or in a direction (D) differing from the said direction. In the latter case, the coated web 1 has, before being detached, followed along with the auxiliary roll 17 over the angle B.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system for coating liquid on both sides of an advancing indefinite length web, said device comprising:

applicator means for applying liquid to both sides of the indefinite length web;

a counter roller positioned downstream relative to said applicator means with respect to a direction of advancing of the indefinite length web whereby said counter roller receives the advancing indefinite length web;

a leveling means positioned adjacent said counter roller for providing a first nip between said leveling means and said counter roller through which the advancing indefinite length web passes; and an auxiliary roller positioned adjacent said counter roller and downstream relative to said leveling means for providing a second nip between said auxiliary roller and said counter roller through which the advancing indefinite length web passes, wherein said auxiliary roller has a diameter less than the diameter of said counter roller, and wherein said auxiliary roller has a harder surface compared to said counter roller.

2. The system according to claim 1, wherein said applicator means comprises a pair of applicator devices each positioned adjacent the other and on opposite sides of the advancing indefinite length web, and wherein said applicator device comprises an applicator body having a cavity to which liquid is advanced for a store of liquid; a slit type applicator orifice extending from said cavity; and a collecting trough positioned below said applicator body for collecting liquid excess that had been applied to the advancing indefinite length web and has flowed down along an outer surface of said applicator body for directing the liquid excess to said trough.

3. The system according to claim 2, wherein said leveling means is a doctor blade.

4. The system according to claim 2, including a holder positioned above said applicator means for supporting said leveling means, and wherein said holder includes a lower surface on which excess liquid, applied to said advancing indefinite length web resulting from the operation of said leveling means, is collected and directed to said trough of one of said applicator devices.

5. The system according to claim 1, wherein said leveling means is a doctor blade.

6. The system according to claim 1, wherein said counter roller is rotated so as to have an outer peripheral speed greater than an advancing speed of the advancing indefinite length web.

7. The system according to claim 1, wherein said advancing indefinite length web is maintained in contact with a portion of a surface of the counter roller located between said first nip and said second nip.

8. The system according to claim 1, wherein said auxiliary roller is driven.

9. The system according to claim 1, wherein said advancing indefinite length web is advanced from said second nip in a direction tangent to both said counter roller and said auxiliary roller.

10. The system according to claim 1, wherein said advancing indefinite length web is advanced along an outer surface of said auxiliary roller after having exited from said second nip and being detached from said auxiliary roller in a direction differing from a direction tangent to both said counter roller and said auxiliary roller.

11. The system according to claim 1, wherein said first nip and said second nip are separated by a distance of 10 to 30 cm.

* * * * *